United States Patent [19]

Moseley, Jr.

[11] 4,226,285

[45] Oct. 7, 1980

[54] MAGNETIC JUNK RETRIEVER

[76] Inventor: Meekie D. Moseley, Jr., Rte. 1, Box R-53 G, Beaumont, Tex. 77706

[21] Appl. No.: 11,378

[22] Filed: Feb. 12, 1979

[51] Int. Cl.[2] ..... E21B 43/00

[52] U.S. Cl. ..... 166/65 M; 175/93; 175/328

[58] Field of Search ..... 166/65 M, 99, 65; 175/40, 45, 50, 308-312, 328, 93, 328; 294/65.5

[56] References Cited

U.S. PATENT DOCUMENTS

| | | | |
|---|---|---|---|
| 474,297 | 5/1892 | Hoffmann | 175/328 |
| 2,339,274 | 1/1944 | Kotnny | 166/65 X |
| 2,569,390 | 9/1951 | Sewell | 175/50 |
| 2,595,632 | 5/1952 | Bivings et al. | 166/65 M |
| 2,650,067 | 8/1953 | Martin | 175/50 |
| 2,709,104 | 5/1955 | Gibbs | 294/65.5 |
| 2,721,726 | 10/1955 | Johnson | 175/328 |
| 3,047,795 | 7/1962 | Pearson | 175/50 X |

*Primary Examiner*—Ernest R. Purser
*Assistant Examiner*—Richard E. Favreau

[57] ABSTRACT

An improved magnetic junk retriever arranged to magnetize a drill bit just prior to its removal from the bottom of the well bore. A wound, electromagnet subassembly is connected between the drill bit and the drill collar. A battery-pack tool is used to energize the electromagnet by lowering the tool through the bore of the drill pipe and collars to contact pins projecting into the bore of the sub. Energizing the electromagnet causes the drill bit to be magnetized.

5 Claims, 3 Drawing Figures

MAGNETIC JUNK RETRIEVER

BACKGROUND OF THE INVENTION

The invention relates to magnetic junk retrievers. More particularly, the invention relates to an improved, substantially more powerful electromagnet subassembly connectable between the drill bit and drill collar, which is energized by a removable power source.

PRIOR ART

The present inventor's U.S. Pat. No. 3,011,819 disclosed and claimed a magnetic junk retriever that was incorporated in a tool, lowerable by wire line operations, to contact the drill bit. The entire magnet was housed in the tool and was intended to furnish sufficient magnetization to the drill bit to magnetize same. Thus, ferrous junk would be attracted to and would be removed by the drill bit when it was retrieved from the well with the drill string. The sub connecting the bit to the drill collar in FIG. 1 of the patent, was formed of monel or other suitable non-ferro magnetic material.

Other patents in this field are U.S. Pat. Nos. 2,657,752 and 2,671,685 issued to J. R. Balleu. The U.S. Pat. No. 2,657,752 Balleu patent is directed to a fishing tool which uses an electromagnet to retrieve ferrous metal junk, the junk being placed in a "basket" for removal to the surface of the well. The electromagnet and power source are a unitary structure, with means for switching on power for the magnet being located within the tool. The U.S. Pat. No. 2,671,685 Balleu patent teaches and claims a somewhat similar "fishing tool," but without the basket for retrieving the ferrous metal junk. Both Balleu patents, however, are directed to "retrieving" junk as opposed to providing a powerful magnetic force to the drill bit.

Other patents in this field are U.S. Pat. Nos. 3,441,307; 2,595,632; 2,493,992; 2,522,294; 2,637,590; and 3,171,486.

One object of the invention is to provide an improved junk retriever which is arranged to magnetize a drill bit whereby pieces of ferrous metal that have broken off and fallen to the bottom of a well bore are attracted and cling to the bit for removal therewith.

Another object of the invention is to provide an improved magnetic junk retriever which includes a drilling sub connecting the drill collar to the drill bit, the sub being coil wound to provide an electromagnetic force to the drill bit when the coil is energized.

Yet another object of the invention is to provide an improved magnetic junk retrieving system, of the character described, which is energized by a battery tool lowered to the sub bore to contact points therein, whereby the sub and attached drill bit may be magnetized whenever desired to permit the retrieving of junk from the bottom of the well.

Further objects and advantages of the invention will be apparent from the following description taken in conjunction with the accompanying drawings, wherein.

SUMMARY OF THE INVENTION

A magnetic junk retrieving assembly for magnetizing a drill bit on the lower end of a drill stem and magnetically insulated therefrom, comprising a drilling sub for connecting a drill bit to a said lower end of a drill stem having a bore extending axially therethrough, the drilling sub being of a ferromagnetic material, a wire coil positioned around the circumference of the drilling sub, the wire coil being connected at each end to conductor means, and means connected to said conductor means, extending into said bore of said drilling sub, for contacting a power source when said power source is lowered into the bore of said drilling sub, whereby the coil is energized to create a magnetic force.

PREFERRED EMBODIMENTS OF THE INVENTION

Figure 1:
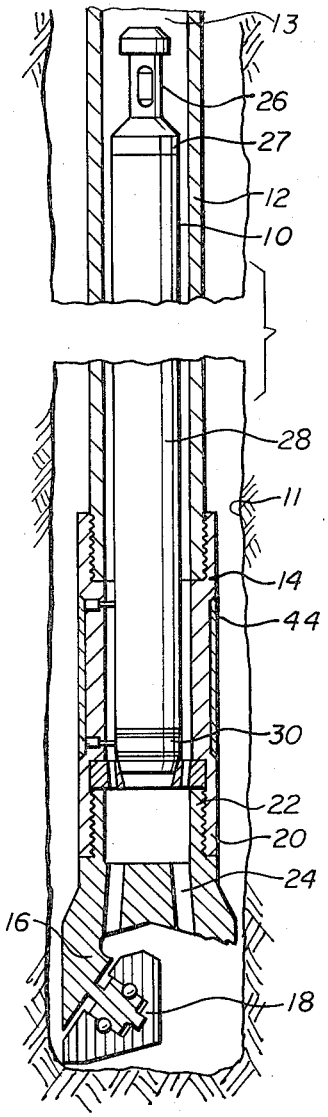
FIG. 1 is a longitudinal, sectional view of a drill collar, sub and bit in a well bore with the bit magnetized by the cooperating relationship of the electromagnetic sub and battery tool, constructed and operated in accordance with the invention.

In the drawings, numeral 11 designates a well bore which may be drilled by a rotary bit 16 mounted on the lower end of a drill collar 12, with a drilling sub 14 connecting the bit 16 to the collar 12. As illustrated in FIG. 1, the bit 16 has an upstanding, threaded pin 22 for screw-threaded engagement with the sub 14. Passages 24 within the bore of the bit 16 provide a conduit for drilling fluid from the drill stem and collar 12 to the cutting elements or teeth 18 of the drill bit 16.

The drill bit pin 22 is received into the box end 20 of the drilling sub 14. The sub 14 provides the electromagnetic force to the drill bit by virtue of the following construction of the sub and its energization from the battery tool 10.

A portion of outside wall of the sub 14 is adapted for being wound with suitable wire. As illustrated, the wire 32 is wound within an excavated portion of the outer wall of the sub 14. When wound, the wire winding 32 is covered by a stainless steel or monel collar 44, which is secured in place by welding same to the sub. The method of securing the collar 44 to the sub should provide an effective seal to prevent water or drilling fluids from passing the seal 34.

The ends 40 and 42 of the wire 32 windings are connected to spaced apart contact switches 36 and 38, respectively. The switches 36 and 38 project through the bore wall 15 of the sub 14. In addition, the switch contact points should extend into the sub bore a sufficient length to provide contact with the battery tool 10, described hereinafter. The switch is movable within a housing to provide for variations in diameter of the battery tool 10. Suitable tensioning means is provided therein to urge the switches 36 and 38 to their most extended position to maintain firm contact with the battery tool 10.

The tool 10 comprises an elongated, cylindrical housing, for holding a plurality of batteries 34 to energize the electromagnetic sub 14. The tool housing 38 is a suitable ferrous steel. Preferably, the body is sectional and has a relatively short sleeve 27 screwthreaded to the upper end of the housing 28. A fishing neck 26 is attached to the upper end of the sleeve 27 and is of the usual construction for detachable connection with a wire line or cable (not shown). The sleeve 27 is removable for loading batteries 34 into the bore of the cylindrical housing 28. A spring 56 within the upper end of the sleeve 27 is provided to tension the batteries and to provide contact with the negative end of the batteries.

There is no particular limit to the number of batteries that may be added to the housing 28, except that the housing should be constructed to provide space for a number sufficient to adequately energize the sub 14.

The lower end of the housing 28 is adapted to receive the positive contact point 54 of the battery tool 10. This element of tool 10 is designed to isolate the contact pin 54 from the housing 28 and the drill bit 16, so that the battery tool 10 is not grounded. The contact pin element is screwthreaded on to the lower end of the housing 28. The portion 47 threaded to the housing 28 is preferably steel, with a suitable insulating material 52 separating the contact pin 54 and conductor element 50 from electrical contact with the tool housing 28.

However, the conductor element 50 projects down through the insulating material 52 and contacts a ferrous steel contact ring 30. The ring 30 is shielded on its lower surface by a second insulating element 48. The insulating element is protected by a steel shock plate 46 attached as the lowest element of the contact pin assembly. The insulating material 48 and 52 may be a hard rubber or plastic. It may be suitable to use a molded Bakelite material as the insulating material.

Figure 2:
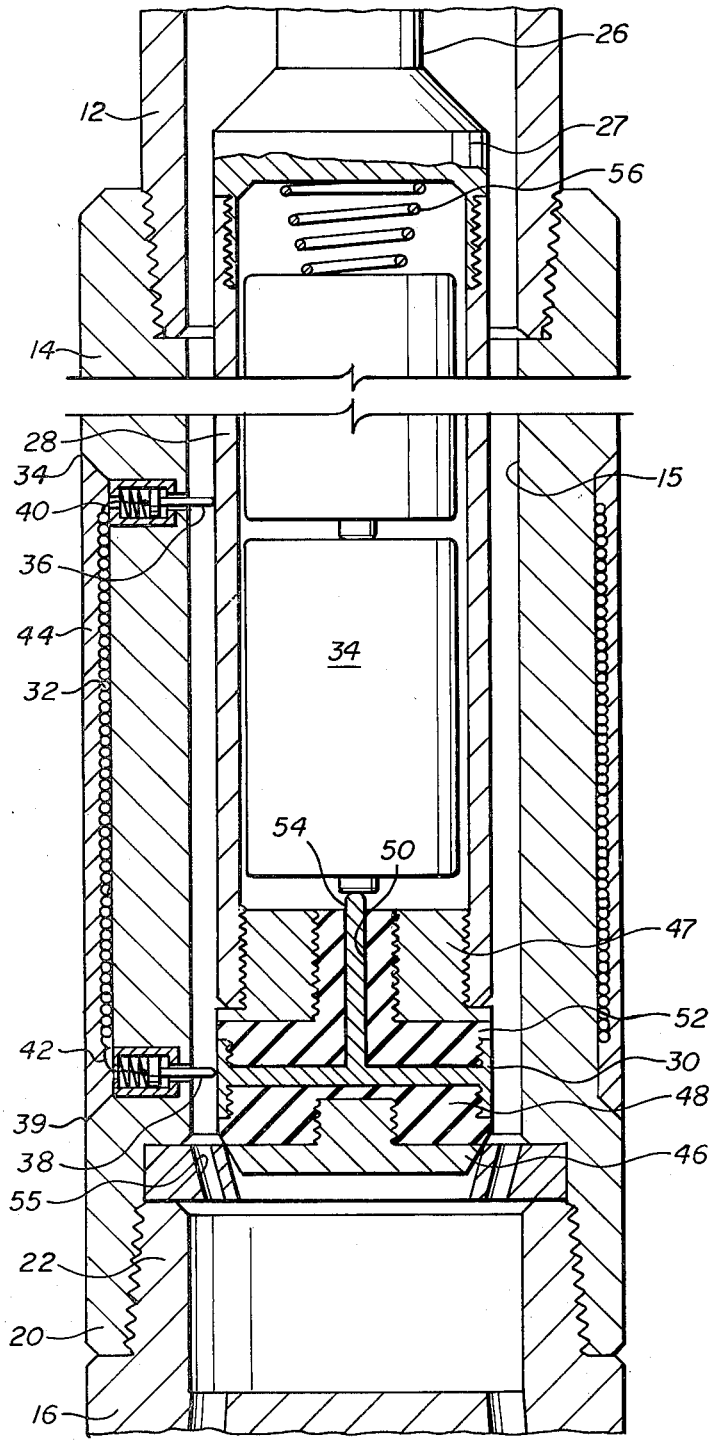
FIG. 2 is a longitudinal, sectional view of the electromagnet sub and battery tool received therein.

The illustration in FIG. 2, showing this lower contact pin assembly, is recognized to be only one of many possible arrangements. It is necessary only to provide electrical isolation to the contact pin 54 and provide for conducting an electrical current to the contact ring 30. The steel shock plate 46 is provided to protect the contact pin assembly from the effects of hard landings on top of the drill bit 16.

When placed in the drill collar 12 and lowered to the sub 14, the two contact pins 36 and 38 are in contact with the tool housing 28. The lower contact pin 38 contacts the steel contact ring 30 housed on the lower end of the tool housing 28. The upper contact pin 36 contacts the housing body 28. Once the electrical circuit is completed, the batteries 34 in the tool 10 energize the sub electromagnet 14, which in turn magnetizes the drill bit 16.

Figure 3:
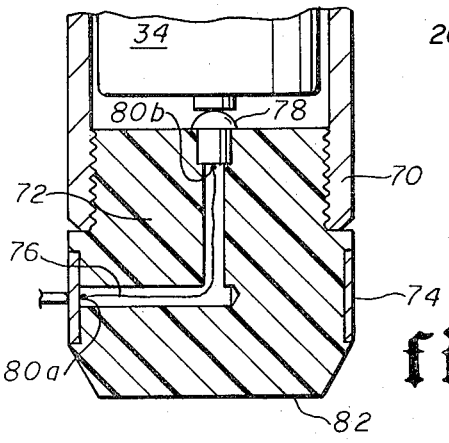
FIG. 3 is a longitudinal, sectional view of a portion of the battery tool, illustrating a variation of the contact pin.

FIG. 3 illustrates yet another embodiment of the contact pin assembly of tool 10, having an insulating material 72 banded about the circumference with an electrical contact ring 74. The contact pin 78 makes contact with batteries 34 and conducts electricity through conductor means 76 to the ring 74. The conductor is attached to the pin and to the ring by suitable means 80*a* and 80*b*. The lower face 82 of the assembly can be of the insulating material, if it will withstand the service requirements. If not, the face 82 can be coated with metal (not shown).

As discussed above, the contact pin assembly of the tool 10 can be designed with many variations to meet the requirements of different service conditions.

When it is desired to retrieve ferrous junk from the well bore 11, the battery tool 10 is dropped, pumped or lowered downwardly through the drill stem and collar 12. Although the tool 10 may be lowered by its fishing neck 26, it is noted that the neck 26 is provided to permit withdrawal of the tool 10 from the drill stem whenever desired.

The present invention is especially useful due to the fact that greater magnetizing force is applied to the drill bit, than previous designs, due to the power of the electromagnet drilling sub 14. The sub 14 is not activated until the tool is lowered into place within the bore of the sub 14.

Once the battery tool 10 is in place within the sub 14, the dislodging of junk embedded in the bottom of the well bore is facilitated by rotation of the bit and the circulation of drilling fluid around the seated tool 10 to the passages 55. The tool 10 would normally be lowered into the drill stem just prior to removal of the stem from the well for changing the drill bit, withdrawing the junk with the stem and bit.

The magnetic power of the sub electromagnet can be regulated by using varying numbers of batteries 34 in the tool 10. A variety of lengths for the tool housing 28 could be utilized for regulating the number of batteries. This could also be accomplished by using extensions (not shown) for the housing 28.

The foregoing description of the invention is explanatory thereof and various changes in the size, shape and material, as well as in the details of the illustrated construction may be made, within the scope of the appended claims, without departing from the spirit of the invention.

I claim:

1. A magnetic junk retrieving system for magnetizing a drill bit on the lower end of a drill stem and magnetically insulated therefrom, comprising a drilling sub, for connecting a drill bit to the lower end of said drill stem, having a bore extending axially therethrough, the drilling sub being of a ferromagnetic material, a wire coil positioned around the circumference of the drilling sub, the wire coil being connected at each end thereof to conductor means, and contact means connected to said conductor means, extending into the bore of said drilling sub, for contacting a power source when said power source is lowered into the bore of said drilling sub, whereby the coil is energized to create a magnetic force, said power source comprising an elongated housing having a bore chamber therein for housing a plurality of batteries, having an upper closed end and a lower closed end, and having a variable capacity for batteries receivable therein, and said lower end having means disposed therein for conducting electricity from said batteries to said drilling sub when said housing is in contact with the contact means of said drilling sub.

2. The magnetic junk retrieving system of claim 1, wherein upper closed end of the housing of said power source has a fishing neck attached thereto, and said upper closed end of the housing is threadably removable from said housing.

3. The magnetic junk retrieving system of claim 1, wherein the lower end of said housing of said power source has means extending into the bore chamber therein for providing electrical contact with the lowermost battery therein and for conducting electricity to an electrical conductor extending around the periphery of said lower end, which is in contact with one of the contact means of said drilling sub.

4. The magnetic junk retrieving system of claim 3, including contact means extending from said drilling sub into the bore thereof and providing electrical contact with the housing of said power source while a second contact means in said sub provides electrical contact with the lower end of said power source housing, in order to complete an electrical circuit and energizing the wire coil of said sub to create a magnetic force transmittable to the drill bit connectable thereto.

5. The magnetic junk retrieving system of claim 3, wherein the peripheral electrical conductor of the lower end of the power source housing is insulated from the housing and from the drill bit connectable to said drilling sub.

* * * * *